US011767155B2

(12) United States Patent
Zeidan

(10) Patent No.: US 11,767,155 B2
(45) Date of Patent: Sep. 26, 2023

(54) CUP COLLAR

(71) Applicant: Numan Zeidan, Hillsborough, CA (US)

(72) Inventor: Numan Zeidan, Hillsborough, CA (US)

( * ) Notice: Subject to any disclaimer, the term of this patent is extended or adjusted under 35 U.S.C. 154(b) by 432 days.

(21) Appl. No.: 15/203,640

(22) Filed: Jul. 6, 2016

(65) Prior Publication Data

US 2017/0361981 A1 Dec. 21, 2017

Related U.S. Application Data

(60) Provisional application No. 62/352,980, filed on Jun. 21, 2016.

(51) Int. Cl.
*B65D 81/38* (2006.01)
*B65D 21/08* (2006.01)

(52) U.S. Cl.
CPC ..... *B65D 81/3865* (2013.01); *B65D 21/083* (2013.01)

(58) Field of Classification Search
CPC .. B65D 23/06; B65D 51/245; B65D 81/3865; B65D 21/083
USPC ..... 220/694; 22/703
See application file for complete search history.

(56) References Cited

U.S. PATENT DOCUMENTS 176,361 A * 4/1876 Schilling ..... 215/41
2,612,031 A * 9/1952 Cockriel ..... A47G 19/22 215/392
3,400,865 A * 9/1968 Johnp ..... A47G 23/0241 222/475
3,632,025 A * 1/1972 Bloomfield ..... A47G 23/0241 222/472
4,559,649 A * 12/1985 Burnett ..... A61B 10/007 4/144.1
5,011,032 A * 4/1991 Rollman ..... A61J 7/04 116/321
5,445,292 A * 8/1995 Slomski ..... A61B 10/007 220/834
5,516,580 A * 5/1996 Frenette ..... D04H 1/54 428/359
2006/0060552 A1* 3/2006 Kasprzak ..... A61J 11/04 215/11.1
2006/0237471 A1* 10/2006 Aafjes ..... B65D 25/48 220/729

(Continued)

FOREIGN PATENT DOCUMENTS

FR 473038 * 9/1913

*Primary Examiner* — Anthony D Stashick
*Assistant Examiner* — Raven Collins
(74) *Attorney, Agent, or Firm* — William C. Milks, III

(57) ABSTRACT

A cup collar includes an extension having a rim at one end and a securing ring at a second end attached to the lip of a cup or other beverage container to allow milk or cream, an additional flavoring, sugar or sweetener, or any other additive to be added to a beverage such as coffee without having to pour out and waste the coffee or other beverage to make room for the additive. The cup collar preferably further includes a skirt having a gasket that engages and locks with a sealing ring on the exterior of the cup proximate the lip of the cup to provide a compression seal between the securing ring and the lip of the cup as well as a seal between the gasket and sealing ring to prevent leakage. The cup collar attachment avoids wasting coffee or other beverage and conserves water.

9 Claims, 2 Drawing Sheets

(56) References Cited

U.S. PATENT DOCUMENTS

2014/0147559 A1* 5/2014 Aidan ..... B65D 23/12
426/115

* cited by examiner

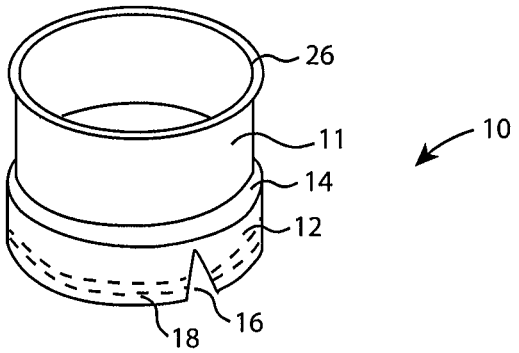
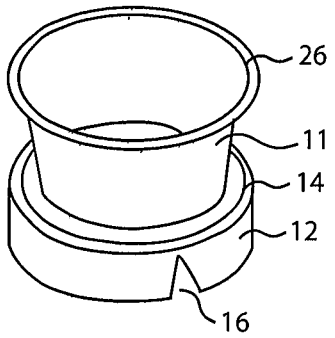
FIG. 3A Conical
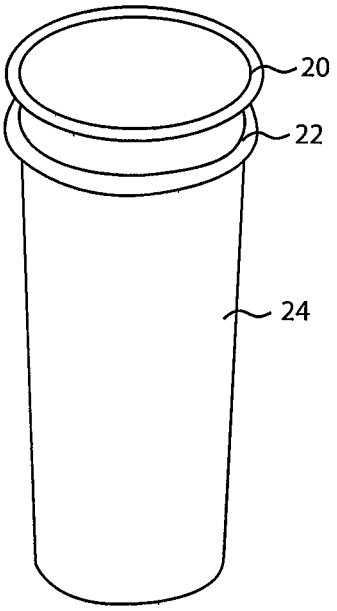
FIG. 2
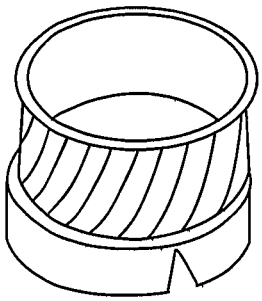
FIG. 3B Spiral
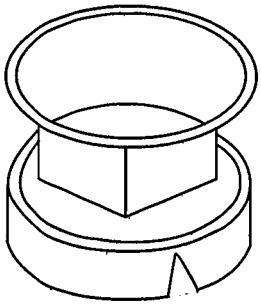
FIG. 3C Square

CUP COLLAR

CROSS-REFERENCE TO RELATED PATENT APPLICATION

This application claims the benefit of U.S. Provisional Patent Application No. 62/352,980 filed on Jun. 21, 2016, entitled CUP COLLAR, the disclosure of which is hereby incorporated herein in its entirety by this reference.

BACKGROUND OF THE INVENTION

1. Field of the Invention

The present invention relates to the field of conserving natural resources. Generally, the present invention relates to conserving water, and, more particularly, conserving water used in beverages such as coffee, tea, or the like.

2. Description of the Prior Art

Currently, in the case of a typical paper cup which is in use at coffee shops, customers pour out coffee into a garbage can to make room for milk, cream, or any other additive, such as flavoring, and condiments, such as sugar or sweetener. This is a waste of coffee and money, but, more fundamentally, is a waste of water used to make the coffee. With the use of a typical paper cup, coffee shop employees may ask customers if they need room for milk or cream, but the amount of room that is selected by the employee may be not enough, resulting in the customer pouring out coffee, or is too much, resulting in customer dissatisfaction because the amount of coffee in the cup is less than what the customer desired.

Also, in the case of a typical paper cup, slipping of the cup from the customer's hand holding the cup is commonplace. Furthermore, having the lid on the cup so close to the customer's hand increases the chance of the lid becoming dislodged, spilling coffee and increasing the risk of hot coffee spilling onto the customer's hand. Additionally, the typical lid does not provide a dependable seal, so coffee may drip out of the cup onto the customer's clothes, damaging expensive clothing. Also, the coffee shop company name and logo or other advertising is covered by the customer's hand that carries the cup, so that branding or advertising is not visible to consumers.

In any event, when coffee is discarded by the customer, water used to make the coffee is wasted. It is estimated that every month across the country there is a lot of wasted water at coffee shops or other businesses, as much as the volume of the Great Lakes combined.

Additionally, when the cup is only partially filled or the customer pours coffee into the garbage can, the cost of the coffee per the volume that is consumable by the customer increases.

SUMMARY OF THE INVENTION

The present invention has as an object to provide a device to conserve water by reducing the unnecessary amount of wasted beverage, such as coffee, contained, for example, in a paper beverage cup. Various examples of the device in accordance with the present invention provide a cup collar attached securely to a paper beverage cup or other beverage container so customers have enough room to add milk or cream or other additive without pouring out a beverage such as coffee and wasting water, coffee, and money. The cup collar preferably further comprises a skirt having a gasket and a sealing ring attached to the exterior of the cup to reinforce the seal between the cup collar and the cup to prevent leakage.

The cup collar in accordance with the preferred example including the skirt, gasket, and sealing ring has several advantages. Because the more coffee poured out and wasted to add milk or cream, the more water is wasted, the cup collar conserves water by avoiding unnecessary waste. The preferred example of the cup collar also prevents slipping of the customer's hand holding the cup, because the skirt prevents slippage and increases safety. Also, in accordance with the preferred example of the cup collar, the gasket disposed in the skirt and the sealing ring attached to the cup produce compression between a securing ring of the cup collar against the lip of the cup to provide a better seal than the lid that is typically used, and also provide an additional seal between the gasket and sealing ring to prevent leakage. The cup collar also further distances the lid away from the customer's hand holding the cup, which improves safety.

BRIEF DESCRIPTION OF THE DRAWING

The various examples of the present invention will be described in conjunction with the accompanying figures of the drawing to facilitate an understanding of the present invention. In the drawing:

FIG. 2 is an isometric view of the cup collar shown in FIG. 1.

FIG. 3, comprising FIGS. 3A-3C, illustrates alternative configurations for a cup extension comprising the cup collar shown in FIGS. 1 and 2.

DETAILED DESCRIPTION OF THE PREFERRED EXAMPLE EMBODIMENTS

Figure 1:
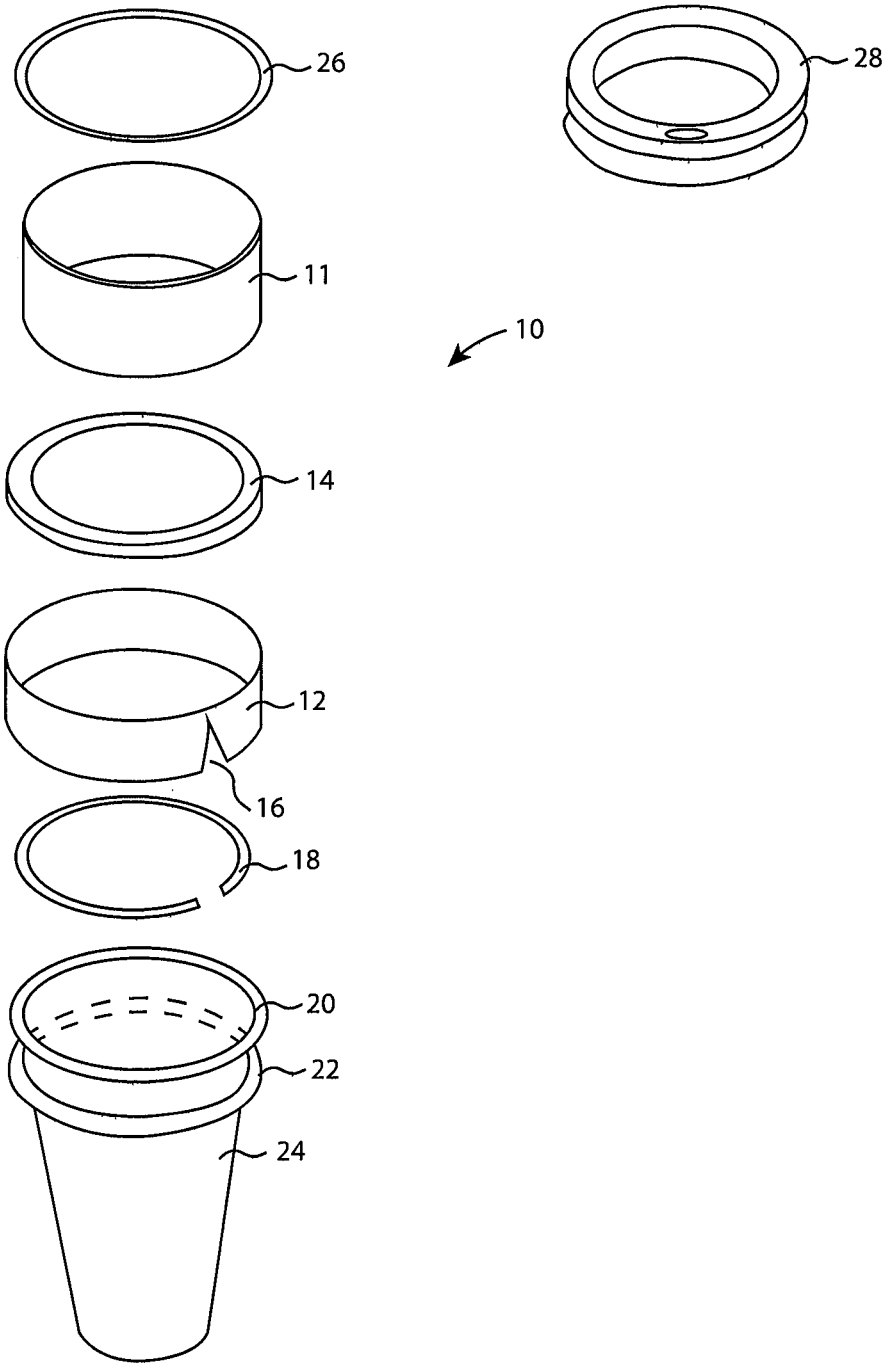
FIG. 1 is an exploded view of a cup collar in accordance with an example of the present invention.

FIG. 1 is an exploded view of the cup collar in accordance with a preferred example of the present invention. FIG. 1 shows the cup collar 10 to provide enough room to add milk or cream, or any other additive, to the beverage contained in a conventional paper cup or other beverage container 24. The cup collar 10 comprises a cup extension 11 having a conventional rim 26 mounted to or formed integrally with the cup extension at a first end of the cup extension and a securing ring 14 mounted to or formed integrally with the cup extension at a second end of the cup extension and configured to attach to and seal with a conventional lip 20 of the cup 24.

Preferably, a skirt 12 is attached to or formed integrally with the securing ring 14. A gasket 18 is disposed within the skirt 12. The skirt 12 is relieved at 16 and the gasket is split to facilitate attachment of the cup collar 10 to the cup 24.

Also, a sealing ring 22 is preferably provided on the cup 24. The sealing ring 22 is attached to or formed on the exterior of the cup 24 proximate the lip 20 of the cup. The gasket 18 engages and locks with the sealing ring 22 when the cup collar 10 incorporating the skirt 12 and gasket 18 is attached to the cup 24.

The securing ring 14 of the cup collar 10 attached to or formed integrally with the skirt 12 having the gasket 18 is attached to the cup 24 such that the skirt and gasket pass over the lip 20 of the cup and the gasket engages and locks with the sealing ring 22. In accordance with the preferred example, there is an attachment and seal both between the securing ring 14 and the lip 20 of the cup 24 and between the gasket 18 and the sealing ring 22 to provide compression between the securing ring and the lip of the cup to thereby reinforce the seal and attachment of the cup collar 10 to the cup 24, and to provide an additional seal between the gasket and the sealing ring to prevent leakage.

FIG. 2 shows the cup collar 10 assembled and ready for attachment to the cup 24. The securing ring 14 which may have a configuration similar to the lower portion of a conventional lid 28 shown in FIG. 1, attaches and seals with the lip 20 of the cup 24, as the gasket 18 engages and locks with the sealing ring 22 on the cup. The gasket 18 expands to slide over the lip 20 and sealing ring 22 and then contracts beneath the sealing ring to reinforce the attachment and seal of the cup collar 10 to the lip 20 by producing compression between the securing ring 14 and the lip, as well as providing an additional seal between the gasket and the sealing ring to prevent leakage.

The customer can place a conventional lid 28 (FIG. 1) on the rim 26. Thus, the customer's hand holding the cup 24 is further displaced from the lid 28 to lessen the risk of the lid becoming dislodged.

The cup extension 11 of the cup collar 10 shown in FIGS. 1 and 2 is illustrated to have a generally cylindrical shape. Alternatively, FIG. 3 shows different attractive and artistic shapes for the cup extension 11 of the cup collar 10. FIG. 3A illustrates the cup extension 11 may have a conical shape similar to the upper portion of an ice cream cone. FIG. 3B shows the cup extension 11 may have a spiral shape. FIG. 3C illustrates the cup extension 11 may have a square shape transitioning into a rounded shape at the top to form the rim 26 and a rounded shape at the bottom to form or attach to the securing ring 14. These are only examples of shapes for the cup collar 10, and the cup collar may be shaped in any other shape, to add an artistic look and make the cup collar 10 and cup 24 more attractive.

Advantageously, in accordance with the preferred example of the invention, the cup collar 10 is easily attached by customers or employees by simply snapping the cup collar on the cup 24 in seconds. Attachment of the cup collar 10 utilizes compression with the aid of the sealing ring 22 on the cup 24 with the gasket 18 disposed in the skirt 12, in addition to the securing ring 14, to provide a secure attachment of the cup collar and prevent leakage. Also, the sealing ring 22 around the top portion of the cup 24 strengthens the cup (or other beverage container) to prevent buckling of the cup when the cup is grasped in a customer's hand.

There are also various other advantages. One advantage is that with the cup collar 10, there is enough room inside the cup collar to add milk or cream, an additional flavoring, sugar or sweetener, or any other additive, so consumers benefit, because they get more for their money, as they do not have to pour out and waste coffee, tea, or other beverage. Another advantage is that advertising, a company name and logo, or other branding is typically covered by the customer's hand that carries the cup 24; but with the cup collar 10, advertising, the company name and logo, or other branding on the cup collar is above the customer's hand at and is visible to customers. The cup collar 10 can be utilized as a signboard being on top of the cup 24, to let customers know about any promotions or specials, and business hours, and it can help to let customers know the time of closing during national holidays, and can be decorated, and colored nicely, for every holiday. Additionally, an advantage is that the cup collar 10 with the skirt 12 can be constructed in any shape, as shown in FIGS. 2 and 3, and decorated to create a conversation piece.

The examples described above are provided by way of example only, and various modifications which will be apparent to persons skilled in the art are contemplated. For example, the cup collar 10 may be constructed and attached to a beverage container at a factory, and the skirt 12 can be provided with threads (instead of the gasket 18 and the need for the sealing ring 22) and screwed onto the beverage container, to attach the cup collar to the beverage container. Accordingly, the scope of the present invention can only be ascertained with reference to the appended claims.

What is claimed is:

1. A structure adapted to be secured to a single-serve beverage cup to increase the liquid-containing volume of the beverage cup for consumption of the beverage by a user, comprising in combination:

a cup extension having a first open end terminating at a first continuous edge and a second open end terminating at a second continuous edge and a continuous wall disposed between the first and second edges defining a volume within the wall between the first and second open ends, wherein the first and second continuous edges lie in substantially parallel planes;

a rim attached to or integral with the first edge of the cup extension;

a securing ring attached to or integral with the second edge of the cup extension, the securing ring being adapted to securely attach to a lip of a single-serve beverage cup to provide a seal between the cup extension and the cup to increase the liquid-containing volume of the cup by the volume within the wall between the first and second open ends of the cup extension;

a skirt attached to or formed integral with the securing ring counterposed to and spaced apart from the cup extension; and a gasket disposed in the skirt at a distance from where the sealing ring is adapted to securely attach to the lip of the single-serve beverage cup; and a separate sealing ring adapted to attach to the single-serve beverage cup on an exterior surface of the cup distal to the securing ring, the sealing ring being configured to engage and lock with the gasket when the structure is securely attached to the cup to thereby produce a compression seal between the securing ring and the lip of the cup as well as a seal between the gasket and the sealing ring to prevent leakage.

2. The structure of claim 1 wherein the wall of the cup extension has an exterior surface adapted to have advertising, a company name and logo, branding, or signage imprinted on or affixed to the cup extension.

3. A structure selectively attachable to a single-serve beverage cup to increase the liquid-containing volume of the cup for consumption of the beverage by a user, comprising in combination:

a cup extension having a first end terminating at a continuous first edge and a second end terminating at a continuous second edge, wherein the first and second continuous edges lie in substantially parallel planes;

a rim attached to or integral with the first edge of the cup extension;

a securing ring attached to or integral with the second edge of the cup extension, the securing ring being adapted to attach to a lip of the single-serve beverage cup;

a skirt attached to or formed integral with the securing ring counterposed to and spaced apart from the cup extension;

a gasket disposed in the skirt at a distance from where the sealing ring is adapted to attach to the lip of the single-serve beverage cup; and a separate sealing ring adapted to attach to the single-serve beverage cup on an exterior surface of the cup distal to the gasket;

wherein the sealing ring is configured to engage and lock with the gasket when the structure is securely attached to the single-serve beverage cup to produce a compression seal between the securing ring and the lip of the cup as well as a seal between the gasket and the sealing ring to prevent leakage.

4. The structure of claim 3 wherein the cup extension has an exterior surface adapted to have advertising, a company name and logo, branding, or signage imprinted on or affixed to the cup extension.

5. A structure in combination with a single-serve beverage cup, comprising:

a single-serve beverage cup comprising an open top having a lip, a closed bottom, and a continuous wall extending from the bottom to the lip of the cup; and a structure, comprising:

a cup extension having a first open end terminating at a first edge and a second open end terminating at a second edge and a continuous wall disposed between the first and second edges, wherein the first and second continuous edges lie in substantially parallel planes;

a rim attached to or integral with the first edge of the cup extension; and a securing ring attached to or integral with the second edge of the cup extension, the securing ring being configured to be attachable to the lip of the single-serve beverage cup;

wherein the securing ring is attached to the lip of the cup to increase the liquid-containing volume of the cup;

a skirt attached to or formed integral with the securing ring counterposed to and spaced apart from the cup extension; and a gasket disposed in the skirt at a distance from where the sealing ring is configured to be attachable to the lip of the single-serve beverage cup; and a separate sealing ring attached to or formed integral with the single-serve beverage cup on an exterior surface of the wall of the cup distal to the lip of the cup;

wherein the sealing ring is configured to engage and lock with the gasket to produce a compression seal between the securing ring and the lip of the single-serve beverage cup as well as a seal between the gasket and the sealing ring to prevent leakage.

6. The combination of claim 5 wherein the cup extension has an exterior surface adapted to have advertising, a company name and logo, branding, or signage imprinted on or affixed to the cup extension.

7. The structure of claim 1, further comprising in combination:

a lid configured to be selectively attached to the rim.

8. The structure of claim 3, further comprising in combination:

a lid configured to be selectively attached to the rim.

9. The structure of claim 5, further comprising in combination:

a lid configured to be selectively attached to the rim.

* * * * *